United States Patent [19]

Oti et al.

[11] Patent Number: 5,048,591

[45] Date of Patent: Sep. 17, 1991

[54] APPARATUS AND METHOD FOR USE IN CASTING

[75] Inventors: James A. Oti, Richmond Heights; Lawrence D. Graham, Chagrin Falls, both of Ohio

[73] Assignee: PCC Airfoils, Inc., Cleveland, Ohio

[21] Appl. No.: 467,912

[22] Filed: Jan. 22, 1990

[51] Int. Cl.[5] ..... B22C 9/08; B22D 27/04

[52] U.S. Cl. ..... 164/122.1; 164/133; 164/361

[58] Field of Search ..... 164/122.1, 122.2, 133, 164/361, 255, 256, 257, 258, 61

[56] References Cited

U.S. PATENT DOCUMENTS 4,961,455 10/1990 Redemske et al. ..... 164/255

FOREIGN PATENT DOCUMENTS 58-38656 3/1983 Japan ..... 164/256

*Primary Examiner*—Kuang Y. Lin

*Attorney, Agent, or Firm*—Tarolli, Sundheim & Covell

[57] ABSTRACT

During the casting of reactive metals, the depletion of reactive elements from molten metal in an article mold cavity is prevented by blocking a feeder passage after filling an article mold cavity with the molten metal. To block the feeder passage, a valve member is floated on the molten metal. As the level of the molten metal rises, the valve member moves into sealing engagement with a valve seat. To make a mold structure containing the valve member, the valve member is positioned in a pattern of the mold structure. After covering the pattern with ceramic mold material, the pattern is removed to leave the valve member in the mold structure.

28 Claims, 5 Drawing Sheets

APPARATUS AND METHOD FOR USE IN CASTING

BACKGROUND OF THE INVENTION

An improved method and apparatus is provided for use in the casting of reactive metals.

During a known casting process, molten metal is poured into a mold and then solidified. If the molten metal contains reactive elements, the reactive elements are depleted by both their reactivity and by vaporization. The depletion of the reactive elements may result in the cast articles having properties which are not satisfactory for the intended use of the articles.

During the casting of single crystal articles, the molten metal in a mold is solidified in a uni-directional manner. In order to effect the uni-directional solidification of the molten metal, the metal remains molten for a relatively long time as the mold is withdrawn from a furnace chamber. The relatively long solidification time enables reactive elements to migrate to the surface of the molten metal and to be vaporized. As the reactive elements migrate from an article mold cavity, the chemistry of the alloy is changed in a manner which can be detrimental to the properties of the cast article.

SUMMARY OF THE INVENTION

The present invention provides an apparatus and method for use in the casting of reactive metals. During the casting of a reactive metal, the depletion of reactive elements from the molten metal in an article mold cavity is prevented by blocking a molten metal feeder passage. To block the feeder passage, a valve member is moved to a closed position blocking an opening through which the molten metal is conducted.

To enable the valve member to move from an open position to the closed position in which the valve member blocks the feeder passage, in one embodiment of the invention, the valve member floats on molten metal in a mold structure. After the article mold cavity has been filled with molten metal, the valve member engages a valve seat to block the feeder passage. Once the feeder passage has been blocked, reactive elements cannot move through the feeder passage and be depleted from the molten metal in the article mold cavity. Therefore, the mold structure can be slowly withdrawn from a furnace chamber without a loss of reactive elements from molten metal in the mold structure.

In order to form the mold structure, a pattern of the article mold cavity and a pattern of the molten metal feeder passage are formed. A valve member is positioned in the pattern. The pattern is then covered with ceramic mold material. The pattern is removed from the covering of ceramic mold material to form the mold structure. The valve member is disposed in the mold structure and is free to move relative to the mold structure.

Accordingly, it is an object of this invention to provide a new and improved method and apparatus for use in the casting of reactive metals and wherein the depletion of reactive elements from molten metal in an article mold cavity is prevented by blocking a feeder passage.

Another object of this invention is to provide a new and improved method and apparatus for use in casting and wherein a member moves to a closed position by floating in molten metal in a mold structure.

Another object of this invention is to provide a method of making a mold structure containing a valve member by positioning the valve member in a pattern, covering the pattern with ceramic mold material and then removing the pattern from the covering of ceramic mold material to form the mold structure with the valve member therein.

Another object of this invention is to provided a new and improved method and apparatus wherein a member blocks a feeder passage in a mold structure during withdrawal of the mold structure from a furnace chamber.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
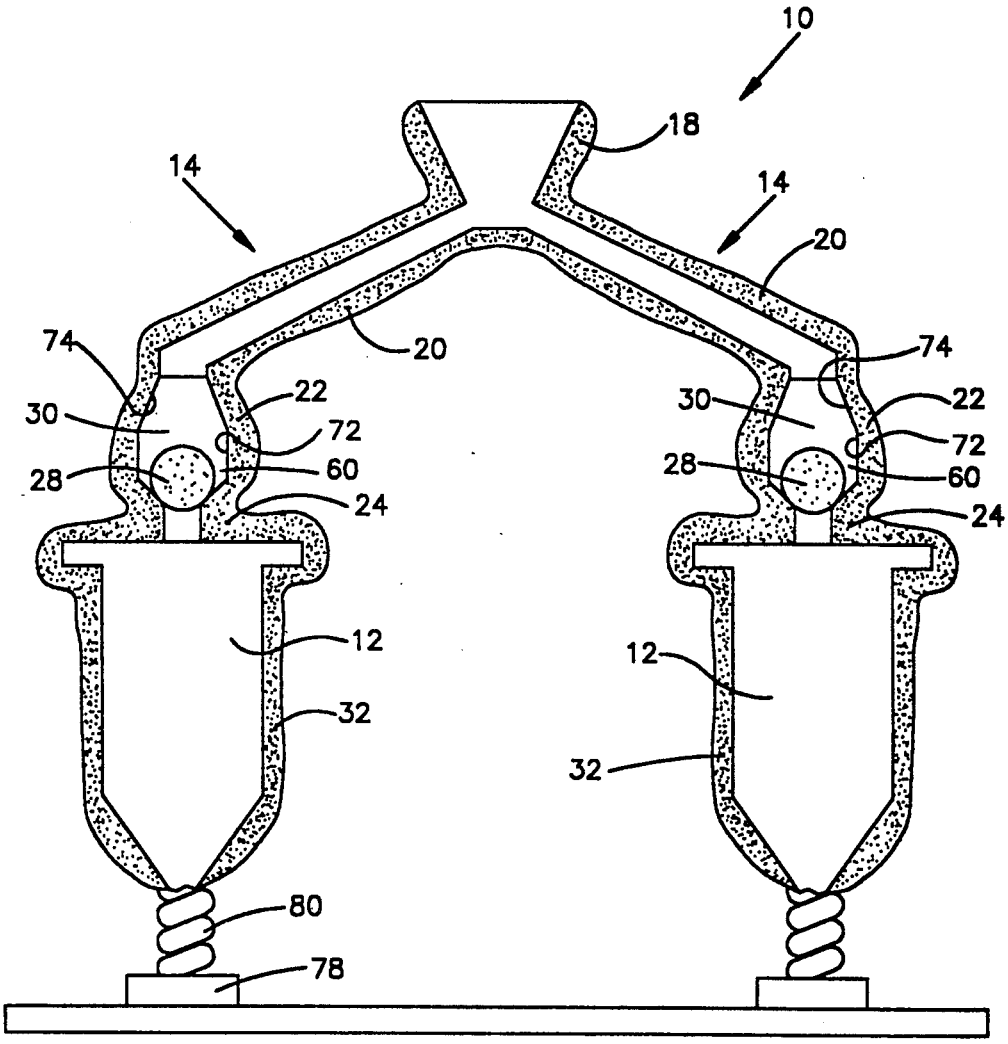
FIG. 1 is a schematicized sectional view of a mold structure constructed in accordance with one embodiment of the present invention.

A mold structure 10 (FIG. 1) constructed in accordance with the present invention, retards the depletion of reactive elements during casting of an article from a reactive metal. Reactive metals are metals which contain one or more elements which tend to be depleted by their reactivity with ceramic molds and/or by vaporization. Among the reactive metals ar nickel chrome superalloys. When a nickel chrome superalloy contains yttrium, there is a particularly strong tendency for the yttrium to be depleted from portions of the alloy during the casting of an article. Other known reactive metals include titanium and its alloys, zirconium and its alloys, aluminum-lithium alloys and alloys containing one or more of the rare earth elements.

The one-piece ceramic mold structure 10 retards the depletion of reactive elements from molten metal in an article mold cavity 12. This is accomplished by blocking a molten metal feeder passage 14 after the article mold cavity 12 has been filled with molten metal which is to be solidified to form a cast article. By blocking the feeder passage 14, movement of reactive elements from the article mold cavity 12 through the feeder passage to the exposed surface of the body of molten metal is blocked. Since the reactive elements cannot move from the article mold cavity 12 through the feeder passage 14 to the surface of the molten metal, the reactive elements cannot be vaporized at the surface of the molten metal.

The one-piece ceramic feeder passage 14 includes a pour cup 18, a runner 20, a valve housing 22 and an inlet portion 24 to the article mold cavity 12. In accordance with a feature of the invention, a valve member 28 is provided in a valve chamber 30 in the valve housing 22. Although only a pair of article molds 32 and associated feeder passages 14 have been shown in FIG. 1, it should be understood that there is an annular array of article molds 32 all of which have runners 20 connected with the pour cup 18. The ceramic article molds 32 are formed as one piece with the feeder passages 14. A valve housing 22 and valve member 28 is provided in the feeder passage 14 for each of the article molds 32.

After an article mold cavity 12 has been filled with molten metal, the level of molten metal in the valve chamber 30 rises. At the level of molten metal in the valve chamber 30 rises, the spherical ceramic valve member 28 floats upwardly from the open position of FIGS. 1, 3 and 4 through the intermediate position of FIG. 5 to the closed position of FIGS. 6 and 7. When the valve member is in the closed position (FIG. 6), the molten metal applies upwardly directed buoyancy force against the valve member urging the valve member t the closed position.

Figure 3:
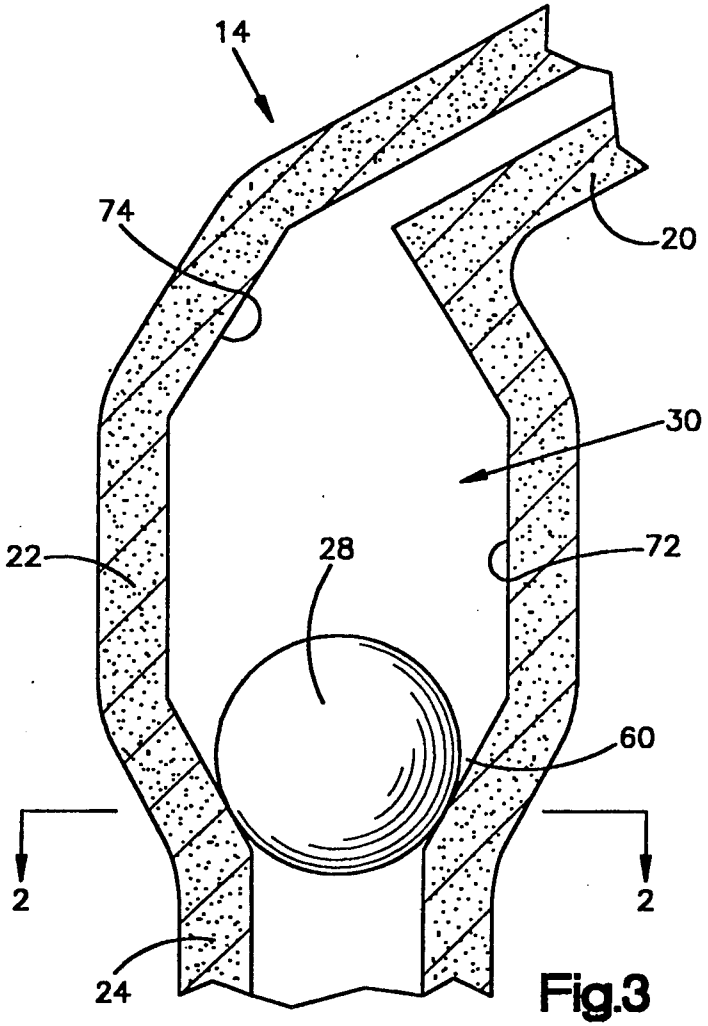
FIG. 3 is an enlarged sectional view of a portion of the mold structure of FIG. 1 and illustrating the relationship between a feeder passage and a valve member when the valve member is in an open position.

When the valve member 28 is in the open position of FIGS. 1 and 3, molten metal can flow around the valve member 28 into the article mold cavity 12. When the valve member 28 is in the closed position, the valve member seals the upper end of the valve cavity 30 to block the feeder passage 14. The closed valve member 28 blocks migration of reactive elements from the article mold cavity 12 (FIG. 1) through the runner 20 to the pour cup 18. If desired, the valve member 28 could be disposed in the article mold cavity 12.

During a casting process, vaporization of reactive elements in the portion of the feeder passage 14 above the closed valve member 28 can occur. However, reactive elements in the article mold cavity 12 cannot migrate past the closed valve member 28 to the molten metal from which the reactive elements have been depleted by vaporization. Therefore, the desired amount of the reactive elements is maintained in the article mold cavity 12.

Casting Process

Figure 2:
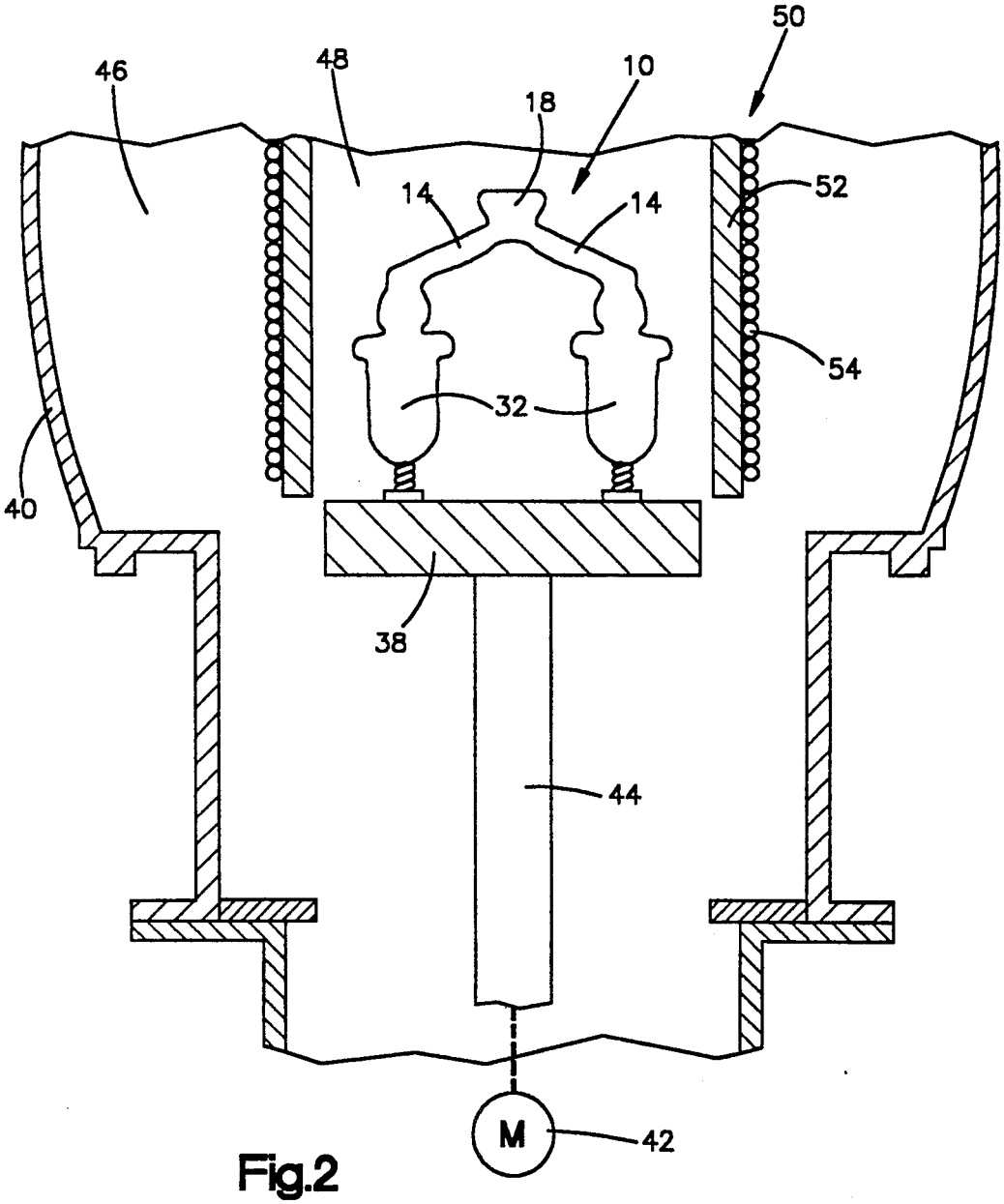
FIG. 2 is a schematic sectional view illustrating the manner in which the mold structure of FIG. 1 is moved into a furnace disposed in an evacuated chamber.

When a casting process is to be undertaken, the one piece ceramic mold structure 10 is placed on a circular water cooled copper chill plate 38 (FIG. 2). This is done while the chill plate is in a fully lowered position adjacent to a lower end of a housing 40. A motor 42 is then operated to move a support post 44, chill plate 38 and mold structure 10 vertically upwardly in the housing 40. The housing 40 is then sealed and a chamber 46 within the housing is evacuated. Evacuation of the chamber 46 removes gases from the chamber to prevent reactions from occurring between the gases and the molten metal.

If desired, a valve (flap) could be provided between upper and lower portions of the housing 40. If this was done, the upper portion of the housing 40 could be maintained in an evacuated condition while the mold structure is placed on the chill plate 38 in the lower portion of the housing. After the lower portion of the housing 40 had been sealed, the valve would be opened and the mold structure moved into the upper portion of the housing.

When the mold 10 has been moved to a raised position, the mold structure is disposed within a cylindrical chamber 48 (FIG. 2) of an induction furnace 50. The furnace 50 has a cylindrical susceptor housing 52 and an induction coil 54. The induction coil 54 is energized to preheat the mold structure 10 to a temperature of approximately 2800 degrees F.

During preheating of the mold structure 10, the copper chill plate 38 is cooled by a flow of liquid through the chill plate. The furnace chamber 48 is continuously evacuated to remove any gases which may be given off by the mold structure 10 a it is preheated. The relationship between the furnace 50 and housing 40 is the same as shown in U.S. Pat. No. 3,841,384.

Once the mold structure 10 has been preheated, molten metal is poured into the frustoconical pour cup 18 and conducted through the runners 20 to the evacuated article molds 32. In one specific instance, the molten metal was a nickel chrome superalloy containing yttrium and the article molds 32 had configurations corresponding to the configuration of turbine blades. However, it should be understood that the apparatus and method of the present invention could be utilized to cast different articles out of different metals.

During the filling of the article molds 32 with molten metal, the molten metal flows from the pour cup 18 through a runner 20 (FIG. 1) into a generally cylindrical valve chamber 30. The molten metal flows around the spherical valve member 28 which is in the open position of FIGS. 3 and 4. The molten metal then flows into the article mold cavity 12 (FIG. 1).

Figure 4:
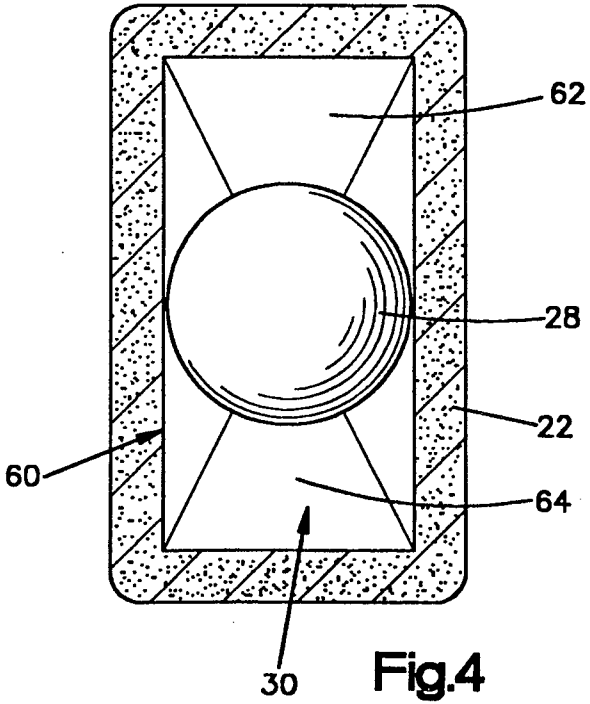
FIG. 4 is a sectional view, taken generally along the line 4—4 of FIG. 3, illustrating the manner in which the valve member is ineffective to block the feeder passage when the valve member is in the open position of FIG. 3.

When the valve member 28 is in its open position, the valve member is disposed in a lower end portion 60 (FIG. 3) of the valve chamber 30. The lower end portion 60 of the valve chamber 30 has a generally rectangular cross sectional configuration (FIG. 4). Therefore, the spherical valve member 28 is ineffective to block fluid flow from the valve chamber 30 into the article mold cavity 12. Thus, spaces 62 and 64 (FIG. 4) are provided around opposite sides of the valve member 28 so that molten metal can freely flow around the valve member downwardly into the article mold cavity.

Although the lower portion 60 of the valve chamber 30 has been shown in FIG. 4 as having a rectangular configuration, it is contemplated that the lower portion of the valve chamber could have a different configuration if desired. For example, the lower portion 60 of the valve chamber 30 could be provided with a generally circular cross sectional configuration and have a plurality of radially outwardly projecting grooves or passages through which the molten metal could flow around the valve member 28. Regardless of the configuration which is selected, the configuration of the lower portion 60 of the valve chamber 30 will be such as to enable molten metal to flow around the valve member 28 into the article mold cavity 12.

Figure 5:
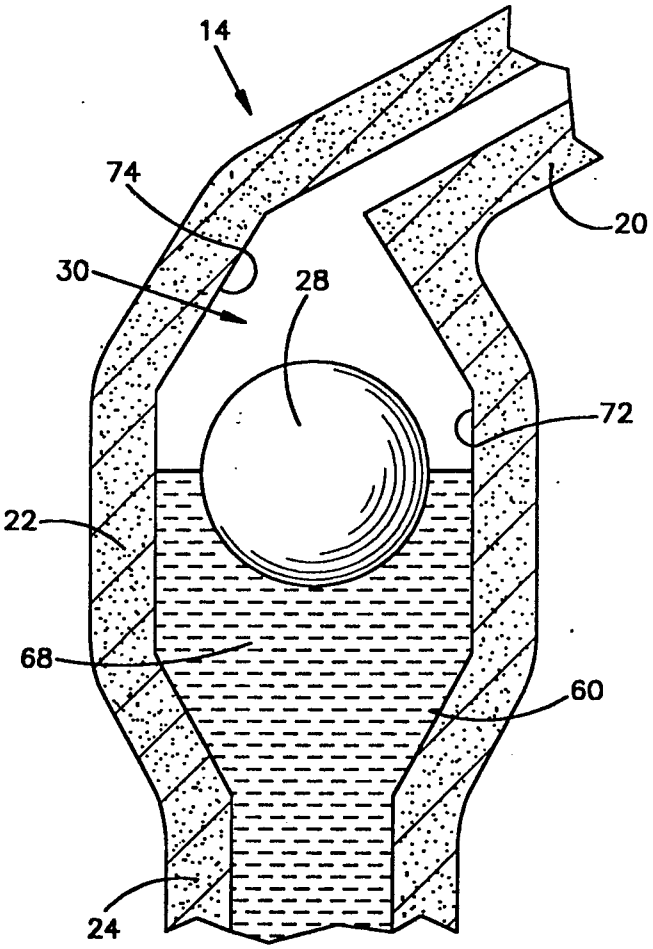
FIG. 5 is a sectional view, generally similar to FIG. 3, illustrating the manner in which the valve member floats in molten metal in the mold structure of FIG. 1.

After the article mold cavity 12 has been filled with molten metal, the level of the molten metal 68 rises in the evacuated valve chamber 30 (FIG. 5). The valve member 28 is lighter than the molten metal 68. Therefore, that the valve member will float on the molten metal 68 as the level of molten metal rises in the valve chamber 30 (FIG. 5).

The spherical valve member 28 is formed of a ceramic material, for example, alumina, having a specific gravity of approximately 3.9 grams per cubic centimeter. The molten metal 68 has a specific gravity of approximately 7.4 grams per cubic centimeter. Since the specific gravity of the molten metal 68 is substantially greater than the specific gravity of the valve member 28, the valve member will float (FIG. 5) on the molten metal as the level of the molten metal rises in the valve chamber 30. It should be understood that the valve member 28 and molten metal 68 could have a specific gravity which is different than the illustrative specific gravities previously set forth.

The buoyancy of the valve member 28 in the molten metal 68 causes the valve member to rise in the valve chamber 30 as the level of the molten metal rises. The spherical valve member 28 has a diameter which is less than the diameter of a cylindrical inner side surface 72 of the valve chamber 30. Therefore, the valve member 28 is free to move upwardly under the influence of buoyancy forces, without being impeded by the inner side surface 72 of the valve housing 22 (FIG. 5).

Figure 6:
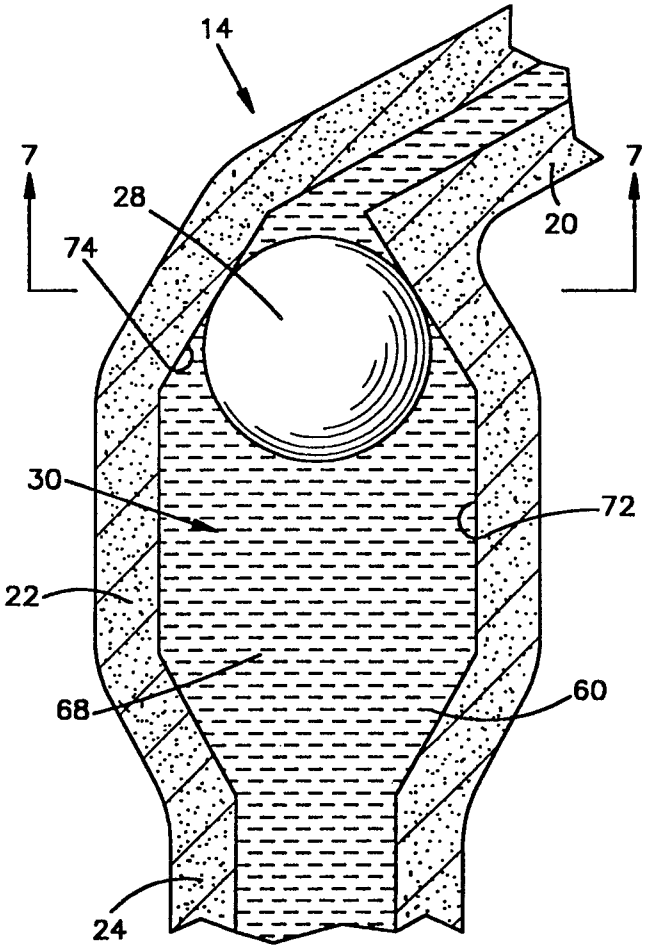
FIG. 6 is a sectional view, generally similar to FIG. 5, illustrating the valve member in a closed position engaging a valve seat and blocking the feeder passage.
Figure 7:
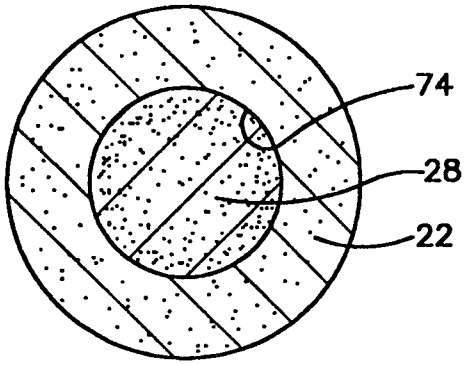
FIG. 7 is a sectional view, taken generally along the line 7—7 of FIG. 6, illustrating the manner in which the valve member engages the valve seat to block the feeder passage.

As the level of molten metal 68 continues to rise in the valve chamber 30, the valve member 28 moves upwardly into engagement with a conical valve seat 74 (FIG. 6). The natural buoyancy of the valve member 28 in the molten metal 68 results in the molten metal applying fluid pressure forces against the valve member. These fluid pressure forces press the valve member 28 into firm sealing engagement with the ceramic valve seat 74 (FIG. 7). Therefore, the spherical valve member 28 seals against the annular valve seat 74 (FIG. 7) to block the migration of reactive elements from the mold cavity 12 (FIG. 1) through the valve chamber 30 (FIG. 6) to the runner 20.

After the valve member 28 has sealingly engaged the valve seat 74 (FIGS. 6 and 7), additional molten metal is conducted into the pour cup 18 and runner 20 to fill the runner and to partially fill the pour cup. As this occurs, the buoyancy forces applied against the valve member 28 by the molten metal 68 maintain the valve member in sealing engagement with the valve seat 74.

Reactive elements in the molten metal 68 can be vaporized at the exposed upper surface of the molten metal in the pour cup 18. Vaporization of reactive elements from the molten metal 68 in the pour cup 18 is promoted by exposure of the upper surface of the molten metal in the pour cup to the evacuated furnace chamber 48. As the reactive elements are vaporized from the molten metal in the pour cup 18, the concentration of the reactive elements in the pour cup is reduced. This promotes migration of the reactive elements from the runner 20 to the pour cup 18 where the reactive elements are vaporized.

However, reactive elements cannot migrate from below the closed valve member 28 to the pour cup 18. Therefore, reactive elements cannot move from the article mold cavity 12 past the closed valve member 28. This results in the depletion of the reactive elements in the molten metal 68 in the article mold cavity 12 being blocked by the closed valve member 28.

During casting of an article in the mold cavity 12 (FIG. 1), it is preferred to have the molten metal 68 directionally solidified upwardly from a lower end of the article mold cavity to an upper end of the article mold cavity. A generally horizontal solidification front is maintained between the molten metal 68 in the upper portion of the article mold cavity 12 and the metal which has solidified in the lower portion of the article mold cavity. When the molten metal 68 is solidified in this manner, the cast article may have either a single crystal or a columnar grain crystallographic structure.

In this illustrated mold structure 10, the articles are to be cast in the mold cavities 12 as single crystals of metal. Therefore, the mold structure 10 includes a starter portion 78 (FIG. 1) and a single crystal selector portion 80. The starter portions 78 and selector portions 80 are formed of ceramic mold material and as one piece with the article molds 32.

A single crystal of metal solidifies upwardly from the selector portion 80 into the lower end of each article mold cavity 12 as the chill plate 38 and mold structure 10 are slowly lowered from the evacuated chamber 48 of the furnace 50. As the chill plate 38 and mold structure 10 continue to be lowered from the furnace 50, the molten metal 68 in the article mold cavity 12 slowly solidifies upwardly throughout the extent of the article mold cavity 12 and feeder passage 14. As the molten metal solidifies in the feeder passage 14, it solidifies around the valve member 28 while the valve member is in engagement with the valve seat 74. Although the molten metal in the mold cavity 12 solidifies as a single crystal, the molten metal in the feeder passage 14 will probably solidify as a plurality of crystals.

A substantial amount of time is required to effect the solidification of the molten metal in the article mold cavity 12 as a single crystal. Thus, approximately one hour may be required to completely lower the article mold 32 from the furnace 50. During the lowering of the article molds 32 from the furnace 50, the housing chamber 46 and furnace chamber 48 are maintained in an evacuated condition.

During the relatively long period of time in which solidification of molten metal occurs in an article mold cavity 12, the valve member 28 is closed and blocks the migration of reactive elements from the article mold cavity. This prevents the depletion of the reactive elements from molten metal in the article mold cavities 12. Although molten metal solidifies in the article mold cavities 12 of the mold structure 10 as single crystals of metal, the present invention could be used in association with mold structures in which the molten metal solidifies with a columnar drained crystallographic structure. In fact, it is contemplated that the present invention may be used in association with the casting of many different metals having different crystallographic structures.

Once the solidification of the molten metal in the mold structure 10 has been completed, the chill plate 38 is lowered, at a relatively high speed, to the lower end portion of the housing 40. The housing 40 is then opened and the mold structure 10 removed from the housing.

Forming the Mold Structure

In order to form the mold structure 10, a pattern 84 (FIG. 8) having a configuration corresponding to the configuration of the article mold cavities 12 and feeder passages 14 is formed. Thus, the pattern 84 includes article patterns 86 having configurations corresponding to the configurations of the article mold cavities 12. Feeder pattern portions 88 have a configuration corresponding to the configuration of the feeder passages 14.

The pattern 84 can be formed of either a natural or synthetic wax or similar material.

Figure 9:
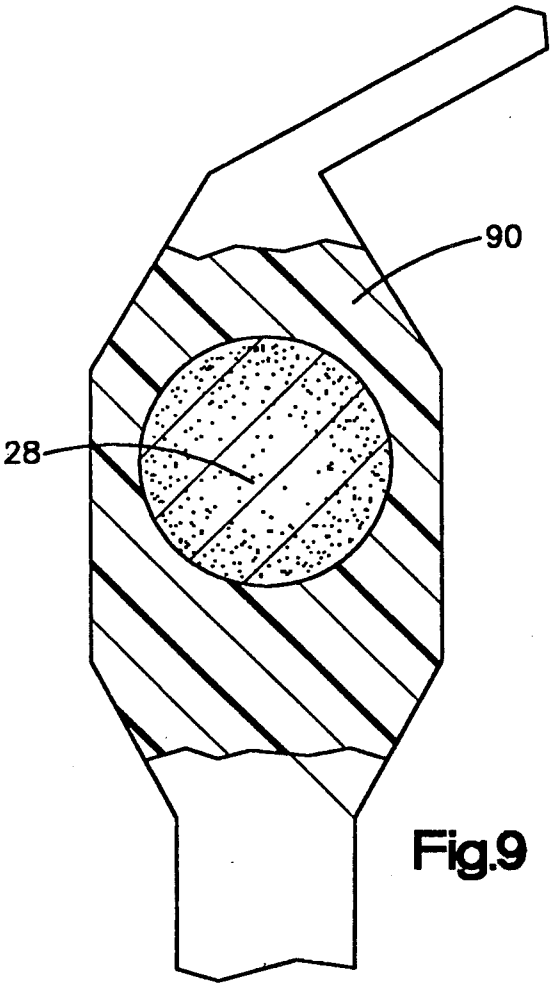
FIG. 9 is a fragmentary sectional view of a portion of the pattern of FIG. 8 and illustrating the manner in which the valve member is positioned in the pattern.

The valve member 28 is disposed in a valve chamber pattern portion 90 (FIGS. 8 and 9) having a configuration corresponding to the configuration of the valve chamber 30. The valve member 28 is positioned in the valve chamber pattern portion 90 in the same manner as in which cores have previously been positioned in patterns. Thus, wire pins may be used to support the valve member 28 in a spaced apart relationship with a pattern die while wax pattern material is injected around the valve member 28 to form the valve chamber pattern portion 90. The wax pattern material completely encloses the valve member 28 (see FIG. 9).

The pattern 84 is then completely covered with liquid ceramic mold material. The liquid ceramic mold material completely covers the exposed surfaces of the pattern. The entire pattern may be covered with the liquid ceramic mold material by repetitively dipping the pattern in slurries of liquid ceramic mold material.

Although many different types of slurry of ceramic mold material could be utilized, one illustrative slurry contains fused silica, zircon and other refractory materials in combination with binders. Chemical binders such as ethalsilicate, sodium silicate and colloidal silica can be utilized. In addition, the slurry may contain suitable film formers, such as alginates, to control viscosity and wetting agents to control flow characteristics and pattern wettability.

In accordance with common practices, the initial slurry coating applied to the pattern 84 may contain finely divided refractory material to produce an accurate surface finish. After the application of the initial coating, the surface is stuccoed with refractory material having a particle size on the order of 60 to 200 mesh. The ceramic mold material completely encases the pattern 84.

After the ceramic mold material has been dried or at least partially dried, the ceramic mold material is heated in a steam autoclave to melt the wax material of the pattern 84. The melted wax is poured out of the pour cup through an open end of the resulting mold. A degreaser is then used to remove any remaining wax.

Since the valve members 28 were completely enclosed by the wax pattern material, the covering of wet ceramic mold material over the wax pattern material does not adhere to the valve members. Therefore, after the ceramic mold material has been dried and the wax pattern material removed from the mold structure 10, the valve members 28 are free to move in the valve chambers 30.

In the illustrated embodiment of the invention, the valve member 28 has been positioned in a valve chamber 30 which is disposed above the article mold cavity 12. It is contemplated that the valve member 28 could be located in the article mold cavity 12 if desired. Of course, the upper end portion of the article mold cavity would have a shape to accommodate the valve member 28 with the valve member disposed above a portion of the article mold cavity in which the article is to be cast. Although the valve member 28 has been described herein in association with an article mold cavity 12 in which a single crystal article, such as a turbine blade is to be cast, the valve member could be used in conjunction with mold cavities in which different types of articles are to be cast.

Conclusion

In view of the foregoing description, it is apparent that the present invention provides a new and improved apparatus and method for use in the casting of reactive metals. During the casting of a reactive metal, the depletion of reactive elements from the molten metal 68 in an article mold cavity 12 is prevented by blocking a molten metal feeder passage 14. To block the feeder passage 14, a valve member 28 is moved to a closed position blocking an opening 74 through which the molten metal 68 is conducted.

To enable the valve member 28 to move from an open position (FIGS. 3 and 4) to a closed position (FIGS. 6 and 7) in which the valve member 28 blocks the feeder passage 14, in the illustrated embodiment of the invention, the valve member 28 floats on the molten metal 68 (FIG. 5) in the mold structure 10. After the article mold cavity 12 has been filled with molten metal 68, the valve member 28 engages a valve seat 74 (FIG. 6) to block the feeder passage 14. Once the feeder passage 14 has been blocked, reactive elements cannot move through the feeder passage and be depleted from the molten metal in the article mold cavity 12. Therefore, the mold structure 10 can be slowly withdrawn from a furnace chamber 48 without a loss of reactive elements from molten metal in the mold structure.

Figure 8:
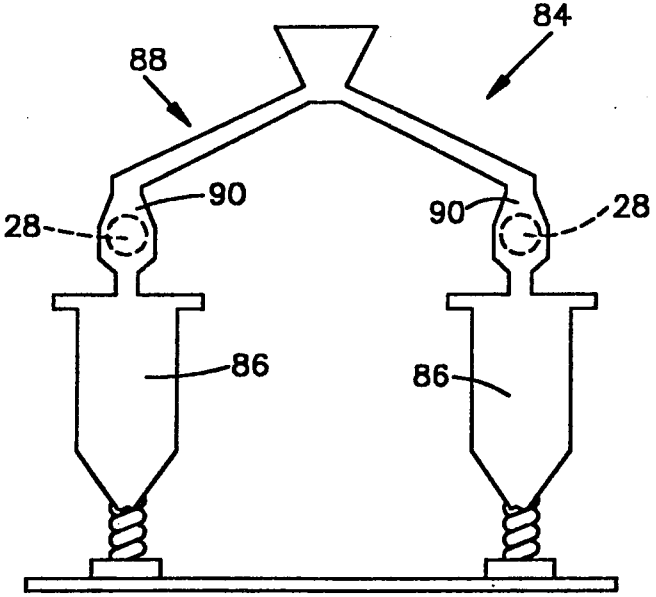
FIG. 8 is a schematic illustration of a pattern for the mold structure of FIG. 1.

In order to form the mold structure 10, a pattern 86 of the article mold cavity and a pattern 88 of the molten metal feeder passage are formed. A valve member 28 is positioned in the pattern (FIGS. 8 and 4). The pattern 84 is then covered with ceramic mold material. The pattern 84 is removed from the covering of ceramic mold material to form the mold structure 10. The valve member 28 is disposed in the mold structure 10 and is free to move relative to the mold structure.

Having described one specific preferred embodiment of the invention, the following is claimed:

1. A method of casting a reactive metal, said method comprising the steps of moving ceramic mold structure into a chamber, evacuating the chamber, conducting a flow of molten reactive metal through a feeder passage into an article mold cavity in the mold structure under the influence of gravity while the mold structure is in the evacuated chamber, and retarding the depletion of reactive elements from the molten metal in the article mold cavity by blocking the feeder passage after filling the article mold cavity with molten metal, said step of blocking the feeder passage includes moving a member to a position blocking the feeder passage by applying force against the member with the molten metal after filling the article mold cavity with molten metal.

2. A method as set forth in claim 1 wherein said step of applying force against the member with the molten metal after filling the article mold cavity with molten metal includes floating the member in the molten metal.

3. A method of casting a reactive metal, said method comprising the steps of moving a ceramic mold structure into a chamber, evacuating the chamber, conducting a flow of molten reactive metal through a feeder passage into an article mold cavity in the mold structure under the influence of gravity while the mold structure is in the evacuated chamber, and retarding the depletion of reactive elements from the molten metal in the article mold cavity by blocking the feeder passage after filling the article mold cavity with molten metal, said step of blocking the feeder passage includes floating a member in the molten metal to move the member to a position blocking the feeder passage.

4. A method as set forth in claim 3 wherein said step of floating a member in the molten metal includes moving the member upwardly from a lowered position to a raised position.

5. A method as set forth in claim 4 wherein the member is disposed in the feeder passage and engages a portion of the feeder passage when the member is in the raised position.

6. A method comprising the steps of forming a pattern of an article mold cavity and molten metal feed passage, positioning a valve member in the pattern, covering the pattern with ceramic mold material, removing the pattern from the covering of ceramic mold material to form a mold structure in which the valve member is disposed, filling an article mold cavity in the mold structure with molten metal, and blocking a metal feed passage in the mold structure with the valve member after filling the article mold cavity with molten metal.

7. A method as set forth in claim 6 wherein said step of positioning a valve member in the pattern includes completely enclosing the valve member with pattern material, said step of covering the pattern with ceramic mold material includes applying a covering of ceramic mold material over the pattern with the ceramic mold material spaced from the valve member.

8. A method as set forth in claim 6 wherein said steps of removing the pattern from the covering of ceramic mold material and filling an article mold cavity with molten metal includes releasing the valve member for movement relative to the covering of ceramic mold material.

9. A method as set forth in claim 6 wherein said step of positioning a valve member in the pattern includes positioning the valve member in the portion of the pattern having a configuration corresponding to the configuration of the molten metal feed passage.

10. A method of casting a reactive metal, said method comprising the steps of moving a ceramic mold structure into a chamber, evacuating the chamber, conducting a flow of molten reactive metal through a feeder passage into an article mold cavity in the mold structure under the influence of gravity while the mold structure is in the evacuated chamber, and retarding the depletion of reactive elements from the molten metal in the article mold cavity by blocking the feeder passage after filling the article mold cavity with molten metal, said step of conducting a flow of molten reactive metal through a feeder passage into an article mold cavity includes conducting the flow of molten metal around a member which is buoyant in the molten metal, said step of blocking the feeder passage includes floating the member upwardly into engagement with a surface of the mold structure which extends around the feeder passage.

11. An apparatus for use in the casting of metals containing one or more reactive elements, said apparatus comprising a ceramic mold structure, said ceramic mold structure including means for at least partially defining an article mold cavity and means for at least partially defining a feeder passage which extends upwardly from the article mold cavity and through which molten metal is conducted downwardly to said mold cavity, and depletion retarding means for retarding depletion of reactive elements from molten metal in said article mold cavity, said depletion retarding means including valve means which is disposed above said article mold cavity and which is operable to a closed condition blocking the feeder passage by force applied against said valve means by the molten metal, said valve means including surface means for at least partially defining a valve chamber which is disposed above said article mold cavity and a valve seat at an upper end portion of said valve member, said valve means further including a valve member movable upwardly in the valve chamber into engagement with the valve seat to block the transmission of reactive elements from the mold cavity and valve chamber.

12. An apparatus as set forth in claim 11 wherein said valve member is buoyant in the molten metal and floats upwardly in the molten metal in the valve chamber into engagement with the valve seat.

13. An apparatus as set forth in claim 12 wherein said valve member is formed of ceramic material.

14. An apparatus as set forth in claim 11 wherein said valve seat extends around a portion of the feeder passage, said valve member being movable upwardly into engagement with said valve seat by the molten metal.

15. An apparatus as set forth in claim 11 wherein said valve member and valve chamber are disposed in said feeder passage above said article mold cavity.

16. A method of casting a reactive metal, said method comprising the steps of moving a ceramic mold structure into a chamber, evacuating the chamber, conducting a flow of molten reactive metal downwardly through a feeder passage into an article mold cavity in the mold structure under the influence of gravity while the mold structure is in the evacuated chamber, and retarding the depletion of reactive elements from the molten metal in the article mold cavity by blocking movement of the reactive elements upwardly through the feeder passage after filling the article mold cavity with molten metal, said step of blocking movement of the reactive elements upwardly through the feeder passage includes moving a valve member upwardly in the mold structure from a lowered position in which the valve member is disposed within the mold structure and is ineffective to block the feeder passage to a raised position in which the valve member is disposed within the mold structure and is effective to block the feeder passage.

17. A method as set forth in claim 16 wherein said step of blocking movement of the reactive elements upwardly through the feeder passage includes moving the valve member upwardly to a position in which the member extends across the feeder passage.

18. A method as set forth in claim 16 wherein said step of blocking movement of the reactive elements upwardly through the feeder passage includes moving the valve member upwardly in the mold structure to the raised position by applying force against the valve member with the molten metal in the mold structure after filling the article mold cavity with molten metal.

19. A method as set forth in claim 16 wherein said step of blocking movement of the reactive elements upwardly through the feeder passage includes floating the valve member in molten metal disposed in the mold structure to move the valve member upwardly in the mold structure to the raised position.

20. A method as set forth in claim 16 wherein the valve member is disposed in the feeder passage and engages a portion of the feeder passage when the member is in the raised position.

21. A method as set forth in claim 16 wherein said step of conducting a flow of molten reactive metal through a feeder passage into an article mold cavity includes pouring the molten metal into an upper end portion of the feeder passage and conducting a flow of molten metal downwardly against and around the valve member.

22. A method as set forth in claim 16 wherein said step of conducting a flow of molten reactive metal through a feeder passage into an article mold cavity includes conducting the flow of molten metal around the valve member which is buoyant in the molten metal, said step of moving the valve member upwardly from the lowered position to the raised position includes floating the valve member upwardly in the mold structure into engagement with a surface of the mold structure.

23. A method of casting an article, said method comprising the steps of flowing molten metal downwardly into a mold structure to form a body of molten metal in the mold structure, floating a valve member at an upper side surface of the body of molten metal in the mold structure, raising the level of the upper side surface of the body of molten metal while floating the valve member to move the valve member upwardly into engagement with a surface area which extends around an opening in the mold structure during performance of said step of floating a valve member at an upper side surface of the body of molten metal in the mold structure, and sealing the opening in the mold structure by maintaining the valve member in engagement with the surface around the opening under the influence of the buoyancy of the valve member.

24. A method as set forth in claim 23 further including the step of solidifying the molten metal in the mold structure to at least partially form a cast article, said step of solidifying the molten metal in the mold structure being performed while maintaining the valve member in sealing engagement with the surface area which extends around an opening in the mold structure.

25. A method as forth in claim 23 wherein said step of flowing molten metal into a mold structure includes conducting a flow of molten metal downwardly around and against the valve member and into an article mold cavity.

26. A method as set forth in claim 25 wherein said step of moving the valve member into engagement with a surface area which extends around an opening in the mold structure includes moving the valve member upwardly into engagement with a surface area which extends around a feeder passage opening.

27. A method as set forth in claim 26 wherein said step of floating a valve member at an upper side surface of the body of molten metal in the mold structure includes floating the valve member with the valve member disposed in the feeder passage.

28. A method as set forth in claim 23 wherein said step of sealing the opening in the mold structure includes blocking the opening to retard the depletion of reactive elements from the molten metal in the mold structure.

* * * * *

UNITED STATES PATENT AND TRADEMARK OFFICE

CERTIFICATE OF CORRECTION

PATENT NO. : 5,048,591

DATED : September 17, 1991

INVENTOR(S) : James A. Oti and Lawrence D. Graham

It is certified that error appears in the above-identified patent and that said Letters Patent is hereby corrected as shown below:

Column 8, line 41, claim 1, after "moving" insert --a--.

Column 10, line 6, claim 11, delete "member" and insert --chamber--.

Signed and Sealed this

Sixteenth Day of March, 1993

*Attest:*

STEPHEN G. KUNIN

*Attesting Officer*

*Acting Commissioner of Patents and Trademarks*